US006050185A

United States Patent [19]

Richards

[11] Patent Number: 6,050,185

[45] Date of Patent: Apr. 18, 2000

[54] PRINTING UNIT FOR A WEB-FED ROTARY PRINTING PRESS

[75] Inventor: John Sheridan Richards, Barrington, N.H.

[73] Assignee: Heidelberger Druckmaschinen AG, Heidelberg, Germany

[21] Appl. No.: 08/979,108

[22] Filed: Nov. 26, 1997

[51] Int. Cl.[7] ..... B41F 9/00; B41F 5/04

[52] U.S. Cl. ..... 101/142; 101/220

[58] Field of Search ..... 101/216, 218, 101/219, 220, 221, 222, 223, 247, 248, 249, 349.1, 142

[56] References Cited

U.S. PATENT DOCUMENTS

| | | | |
|---|---|---|---|
| 1,421,982 | 7/1922 | Nordfors | 101/349.1 |
| 2,022,696 | 12/1935 | Tomlin et al. | 101/220 |
| 2,185,310 | 1/1940 | Quick et al. | 101/221 |
| 3,274,930 | 9/1966 | Nagel | 101/221 |
| 3,724,368 | 4/1973 | Treff | 101/247 |
| 4,072,104 | 2/1978 | Schaffer | 101/247 |
| 4,183,297 | 1/1980 | Skiera | 101/220 |
| 5,161,463 | 11/1992 | Knauer et al. | 101/220 |
| 5,429,048 | 7/1995 | Gaffney et al. . | |
| 5,440,981 | 8/1995 | Vrotacoe et al. . | |
| 5,692,439 | 12/1997 | Wech | 101/220 |
| 5,771,804 | 6/1998 | Knauer et al. | 101/216 |

FOREIGN PATENT DOCUMENTS

| | | |
|---|---|---|
| 0 644 048A2 | 12/1994 | European Pat. Off. . |
| 4138479 | 6/1993 | Germany . |
| 63-236651 | 10/1988 | Japan . |

*Primary Examiner*—Eugene Eickholt

*Attorney, Agent, or Firm*—Burns, Doane, Swecker and Mathis, LLP

[57] ABSTRACT

Apparatus for a web-fed rotary printing press is provided with a first plate cylinder associated with a first blanket cylinder and a second plate cylinder associated with a second blanket cylinder with the second blanket cylinder being in rolling contact with and being mechanically coupled to the first blanket cylinder. A first drive motor individually drives the first plate cylinder. A second drive motor individually drives the second plate cylinder. A third drive motor is used to drive both the first and second blanket cylinders mechanically independently of the first and second motors.

24 Claims, 4 Drawing Sheets

PRINTING UNIT FOR A WEB-FED ROTARY PRINTING PRESS

BACKGROUND OF THE INVENTION

1. Field of the Invention

The present invention relates to a blanket-to-blanket printing unit for a web-fed rotary printing press, in which each of the plate cylinders is individually driven by an associated drive motor and in which the blanket cylinders are mechanically coupled to each other and are driven by one common drive motor. In particular, the present invention relates to a printing unit for a web-fed rotary printing press for printing newspapers, in which each of the blanket cylinders carries a sleeve shaped printing blanket.

2. State of the Art

In a lithographic web-fed rotary printing press, a running paper web is usually fed through a plurality of blanket-to-blanket printing units, which apply a multi color image to both sides of the web. For driving the printing units, there are different known kinds of drive systems and drive principles from the prior art.

One of the most common driving principles which is used In most of today's web-fed rotary printing presses employs a longitudinal drive shaft which is coupled to a main drive of the printing press and which drives each blanket-to-blanket printing unit via a bevel gear respectively, The bevel gear is connected to a gear train of the respective printing unit, which includes the meshing drive gears of the upper and lower plate cylinders and their associated blanket cylinders.

DE 41 38 479 Al of "Baumueller" describes a blanket-to-blanket printing unit in which each of the upper and lower plate- and blanket cylinders is driven independently by an own electric motor, without providing a mechanical coupling between the cylinders. Owing to a differential motion between the upper and the lower blanket cylinders of the printing unit, which could occur in case of web-fed printing presses having blanket cylinders with sleeve-shaped printing blankets, register errors and print defects are likely to occur. Furthermore, the use of one individual electric motor for each of the cylinders of the printing unit requires a highly sophisticated control and regulating electronics, in order to avoid misregistering of the Images particularly at high press speeds.

EP 0 64 44 048 A2 purports to disclose a blanket-to-blanket printing unit for a web-fed rotary printing press, in which the upper plate cylinder and its associated upper blanket cylinder are mechanically coupled via a first gear train and are driven by a first electric motor via a first gear box. The lower blanket cylinder and its associated lower plate cylinder are mechanically coupled via a second gear train and are driven by a second electric motor via a second gear box. The document further describes a satellite printing unit in which the central impression cylinder is driven by a first electric motor and in which the plate- and blanket cylinders of each satellite printing couple are mechanically connected via a gear train and are driven independently by an associated own electric motor. Each of the electric motors for driving the printing couples is mechanically connected to the respective blanket cylinder of the couple, in the same way as the printing unit of DE 41 38 479 A1, the printing units described in EP 0 64 40 48 A2 may also be subject to register errors and print defects, which are caused by the creeping of the printing blankets on the first and second blanket cylinders of each printing unit when employing cantilevered blanket cylinders carrying sleeve-shaped printing blankets.

JP 63-236651 purports to disclose a blanket-to-blanket printing unit for a web-fed rotary printing press, In which an upper blanket cylinder and an associated upper plate cylinder are for driving purposes connected via a first gear train and in which a lower blanket cylinder and an associated lower plate cylinder are connected for driving purposes via a second gear train. A first motor is drives the upper plate cylinder and a second motor drives the lower blanket cylinder. The apparatus described in JP 63-23661 is also likely to cause register problems and print defect when employing blanket cylinders with sleeve-shaped printing blankets.

OBJECT OF THE INVENTION

Having outlined the state of the art and its attendant disadvantages, it is accordingly an object of the present invention to provide for a blanket-to-blanket printing unit in which the occurrence of printing defects, In particular register errors between the upper printing couples and the lower printing couples are eliminated, Moreover, It is a further object of the present invention to provide for a blanket-to-blanket printing unit in which the printing plates of the upper and/or the lower plate cylinders can be replaced while the printing press is in operation; and which can further be either operated in an imprinting mode.

According to a first object of the present invention, a printing unit for a web-fed rotary printing press comprises a first plate cylinder, a first blanket cylinder associated with the first plate cylinder, a second plate cylinder and a second blanket cylinder associated with the second plate cylinder. The first blanket cylinder is in rolling contact with the second blanket cylinder and is mechanically coupled to the second blanket cylinder. The printing unit according to the present invention further comprises a first drive motor for individually driving the first plate cylinder, a second drive motor for individually driving the second plate cylinder and a third drive motor for driving both the first and second blanket cylinders.

Pursuant to a further exemplary embodiment of the invention, the first and second blanket cylinders are mechanically coupled via meshing gear wheels, whereby the gear wheels may be mounted to respective drive shafts of the first and second blanket cylinders and wherein the third drive motor may drive the first and second blanket cylinders via a drive gear which comprises a gear wheel or a drive belt.

The first and second blanket cylinders may comprise respective drive shafts and the third drive motor may directly drive the first or second blanket cylinders via an associated drive shaft.

According to another preferred embodiment of the invention, the first plate cylinder and the second plate cylinder may be directly driven by their associated first drive motor and associated second drive motor without employing a gear box. In this embodiment, the first plate cylinder may be driven by the first drive motor via a drive gear which may comprise a gear wheel or a drive belt.

Accordingly, It may also be conceivable that the second plate cylinder is driven by the second drive motor via a drive gear comprising a gear wheel or a drive belt.

Pursuant to another exemplary embodiment of the invention, the first plate cylinder and/or the second plate cylinder are engageable and disengageable from their associated first and second blanket cylinders respectively, when the printing unit is In operation. Moreover, in this embodiment of the invention, the printing unit may be operated as an imprinter printing unit, In which the first and second plate cylinders may be brought in contact with and be separated from their associated blanket cylinders in aftemation, in order to altematively print Images on one side of the web and prepare the printing couple for printing on the other side of the web in a subsequent print job, without interrupting the printing process. For example, two or more successive printing units associated with each other can be operated in an imprinting mode in which the plate cylinders of the respective printing units which are associated with one side of the web or the other can be alternately engaged and disengaged from their associated blanket cylinders to alternately print images on a given side of the web. As such, a printing plate can be changed in one print unit while the other print unit continues to print the web.

Pursuant to a further embodiment of the invention, the blanket cylinders may be known cantilevered blanket cylinders wit sleeve shaped or endless tubular printing blankets mounted thereon, as they are e.g. described In U.S. Pat. No. 5,440,981 or U.S. Pat. No. 5,429,048, the contents of which is hereby incorporated by reference in its entirety. U.S. Pat. No. 5,420,048 also describes known blanket cylinders.

BRIEF DESCRIPTION OF THE DRAWINGS

The present invention, together with additional objects and advantages thereof will be best understood from the following description of specific exemplary embodiments when read in connection with the accompanying drawings, in which.

Figure 1:
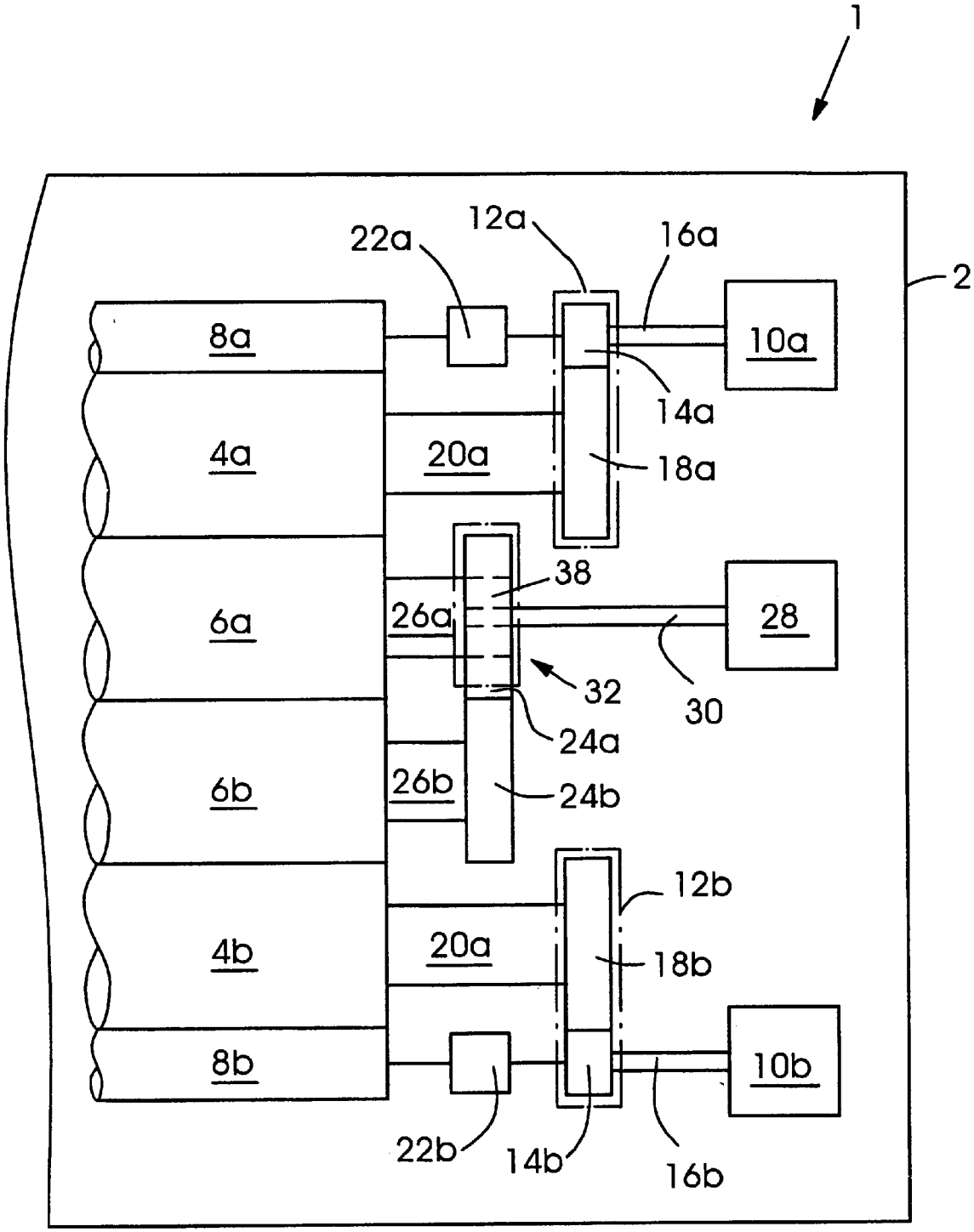
FIG. 1 is a schematic view of a first embodiment of a blanket-to-blanket printing according to the present invention, in which the plate- and blanket cylinders are driven by three associated drive motors via gear wheels.

As it is shown in FIG. 1, a blanket-to-blanket printing unit 1 for a web-fed rotary printing press, preferably a lithographic newspaper printing press, comprises a housing 2, in which a first upper plate cylinder 4*a,* an associated first upper plate cylinder 6*a,* a second lower blanket cylinder 4*b* and an associated second lower blanket cylinder 6*b* are rotatably supported by bearings not shown . Although the cylinders 4*a,* 4*b,* 6*a* and 6*b* are Indicated to be In rolling engagement with each other, each of the plate cylinders 4*a,* 4*b* can be separated from Its associated blanket cylinder 6*a,* 6*b* by means of a known throw-off mechanism (not shown), as it is e.g. described In U.S. Pat. No. 5,301,609, the content of which is hereby Incorporated by reference in its entirety. In the same way as described before, the first blanket cylinder 6*a* and the second blanket cylinder 6*b* may also separated from each other by a known throw-off mechanism, e.g. the one described in U.S. Pat. No. 5,301,609.

As it is further shown in the drawings, one or more inker rollers 8*a,* 8*b* may be associated with each of the first and second plate cylinders 4*a,* 4*b,* in order to apply ink to the printing plates (not shown) mounted on each of the plate cylinders 4*a,* 4*b.*

According to a first exemplary embodiment of the invention which is shown in FIG. 1, a first drive motor 10*a* for individually driving the first plate cylinder 4*a* is mechanically coupled to the first plate cylinder 4*a* via a first gear train 12*a* which preferably includes a gear wheel 14*a* mounted to a drive shaft 16*a* of the first drive motor 10*a* and a gear wheel 18*a* mounted to a drive shaft 20*a* of the first plate cylinder 4*a.* As K is schematically indicated in FIG. 1, the first drive motor 10*a* may drive the first inker roller 8*a* associated with the first plate cylinder 4*a* either directly or via a further drive 22*a.*

In the same way, a second drive motor 10*b* is mechanically coupled to the second plate cylinder 4*b* via a second drive gear 12*b,* which may Include a gear wheel 14*b* mounted to the drive shaft 16*b* of the second drive motor 10*b* and a gear wheel 18*b* mounted to the drive shaft 20*b* of the second plate cinder 4*b.*

The inker rollers 8*b* associated with the second plate cylinder 4*b* may be driven by the second drive motor 10*b* either directly or by means of a drive 22*b* connected to the drive shaft 16*b* or the gear wheel 14*b* of the second drive motor 10*b.* In some applications however, it may also be advantageous to directly drive the inker rollers 8*a,* 8*b* one or more independent motors (e.g., an electric motor, or via gear wheels, drive shafts 20*a,* 20*b* or grears 18*a,* 18*b*).

As it can further be seen from FIG. 1, the first blanket cylinder 6*a* and the second blanket cylinder 6*b* are mechanically coupled to each other by gear wheels 24*a* and 24*b,* which may be mounted to respective drive shafts 26*a* and 26*b* of the first blanket cylinder 5*a* and the second blanket cylinder 6*b* respectively.

In the embodiment shown in FIG. 1, a third drive motor 28 drives the first blanket cylinder 6*a* and the second blanket cylinder 6*b* via a drive gear 32 which may comprise a gear wheel 38 mounted to the drive shaft 30 of the third drive motor 28. The gear wheel 38 may be in meshing engagement with the gear wheel 24*a* of the first blanket cylinder 6*a* (as shown in FIG. 1) or with the gear wheel 24*b* of the second blanket cylinder 6*b.*

Figure 2:
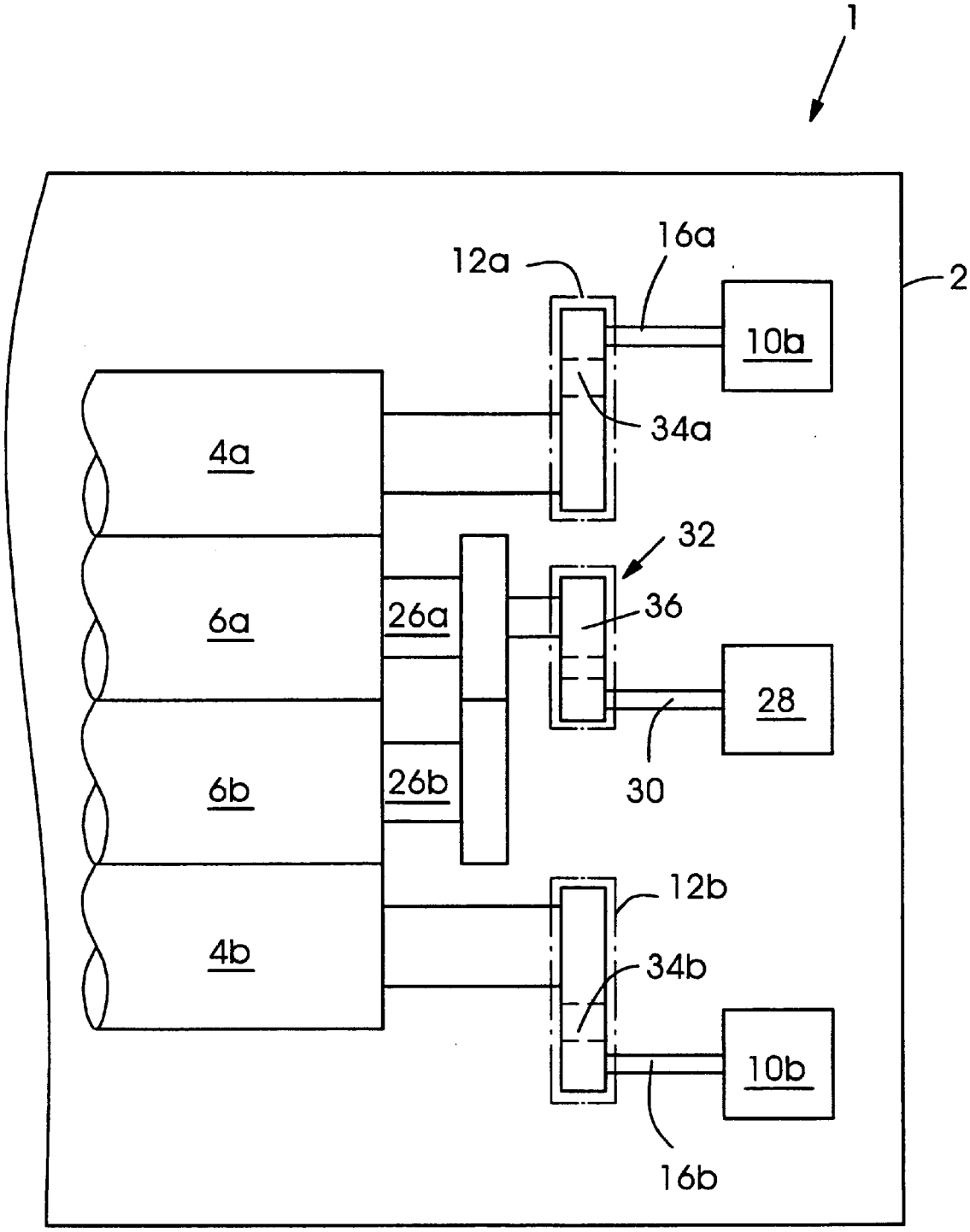
FIG. 2 is a further embodiment of a blanket-to-blanket printing unit, in which the cylinders are driven via drive belts.

According to a further embodiment of the present invention which is shown in FIG. 2, the first and/or second plate cylinders 4*a,* 4*b* are driven via drive belts 34*a,* 34*b* and associated pulleys, respectively. In other words, the drive gears 12*a* and 12*b* for driving the first and second plate cylinder 4*a,* 4*b* are formed by or may at least include a drive belt 34*a,* 34*b* and respective pulleys. The drive belts 34*a,* 34*b* may be known timing belts, which have the ability of damping vibrations and swing which may result from concentricity errors of the cylinders and/or gear wheels and pulleys when the printing unit 1 is in operation. Moreover, the use of drive belts 34*a,* 34*b* has the further advantage that the drive motors 10*a,* 10*b* may have a larger diameter than their associated first and second plate cylinders 4*a,* 4*b,* which provides for a wider range of possibilities in the design of a printing unit 1.

As it is further shown in FIG. 2, it may also be advantageous to use a further timing belt 36 and respective pulleys, for driving the first and second blanket cylinder 6*a,* 6*b.* In other words, the drive gear 32 for driving the first and second blanket cylinders 6*a,* 6*b* may be a drive beft 36 or may at least include a drive belt 36 and respective pulleys mounted to the drive shaft 30 of the third drive motor 28 and the drive shaft 26*a,* 26*b* of the first or second blanket cylinder 6*a,* 6*b,* respectively.

Figure 3:
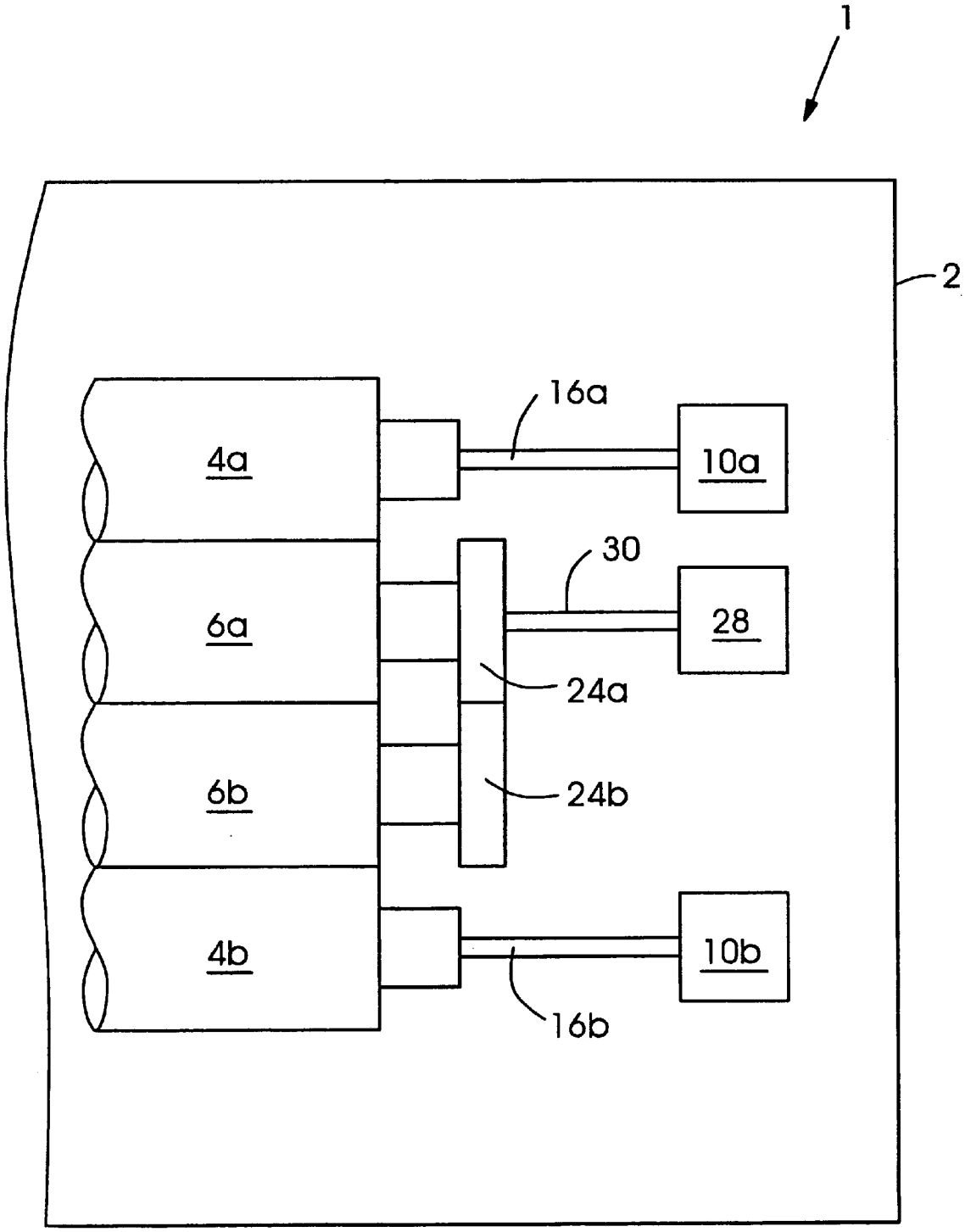
FIG. 3 is a further embodiment of a blanket-to-blanket printing unit according the present invention, in which the first and second plate cylinders are directly driven by associated drive motors and in which the third drive motor is directly drives one of the blanket cylinders.

According to a further exemplary embodiment of the invention which is shown in FIG. 3, the first plate cylinder 4*a,* the second plate cylinder 4*b* and/or the mechanically coupled first and second blanket cylinders 6*a,* 6*b* may be directly driven by their associated drive motors 10*a,* 10*b* and 28 via drive shafts 16*a,* 16*b* and 30, respectively. In this embodiment of the invention, the drive motors 10*a,* 10*b* and 28 may also be arranged in different planes by using drive shafts 16*a,* 16*b* and 30 of a different length, so that the housings of adjacent drive motors, e.g. the drive motors 10*a* for the first plate cylinder 4*a* and the drive motor 28 for the first blanket cylinder 6*a* may have a larger diameter than the diameter of their associated plate cylinder or blanket cylinder.

Although in the embodiments of FIGS. 1 to 3 all of the plate cylinders 4*a,* 4*b* and blanket cylinders 6*a,* 6*b* are shown to be driven by the same type of driving means (direct drive, drive gear with gearwheels or a driving belt), it will be appreciated by those skilled in the art that different types of drive means, e.g. a direct drive for driving the first and second blanket cylinders 6*a,* 6*b* and a drive belt 34*a,* 34*b* for driving the first plate cylinder 4*a* and/or the second plate cylinder 4*b* could be employed.

Figure 4:
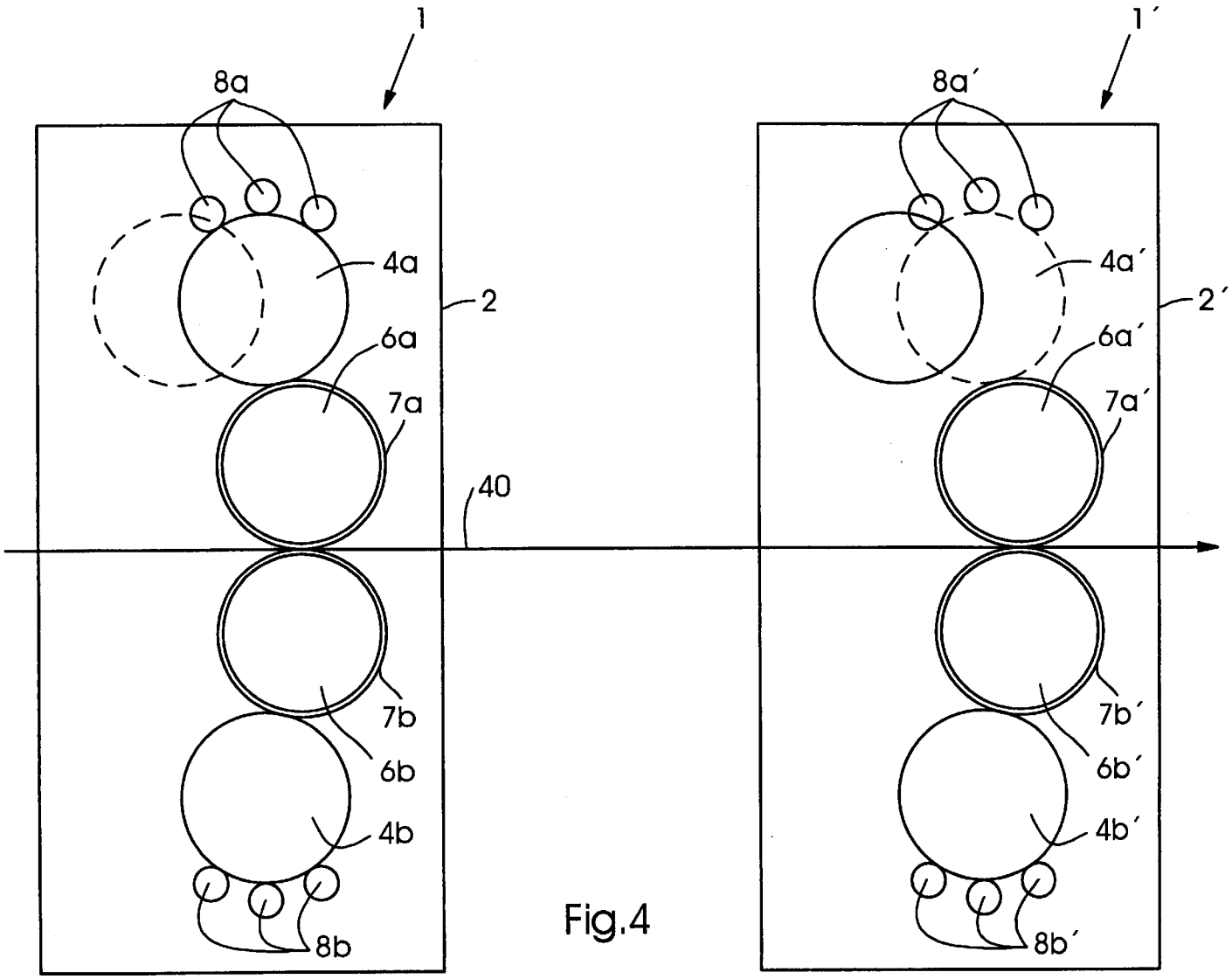
FIG. 4 is a schematic side view of two associated blanket-to-blanket printing units according to the present invention, when operated in an imprinting mode.

As it is shown in FIG. 4, the blanket-to-blanket printing unit 1 according to the present invention may further be used as an imprinter printing unit for alternatively printing different types of images onto a running web 40 without interrupting the printing process for make ready operations. In order to operate the blanket-to-blanket printing unit 1 of the present invention as an imprinter printing unit, the first plate cylinder 4*a* of the printing unit 1 may be separated or disengaged from its associated first blanket cylinder 6*a,* as it is indicated by the dashed lines in FIG. 4 and may afterwards be stopped and equipped with new printing plates for a new image, while the associated first blanket cylinder 6*a* is still in contact with the running web 40. In this mode of operation, the lower second plate cylinder 4*b* and its associated blanket cylinder 6*b* are in rolling contact with each other and with the web 40 and transfer a colored Image to the lower side of the running web 40. The upper side of the running web 40 however, remains unprinted by the first printing unit 1, because the upper plate cylinder 4*a* is separated from the upper blanket cylinder 6*a* and no ink is transferred to the upper side of the web 40 by the first printing unit 1.

After a predetermined number of signatures has been printed in the arrangement of the printing unit 1 which is indicated in dashed lines in FIG. 4, the first upper plate cylinder 4*a* is reaccelerated by the first drive motor 10*a,* until its speed and phase matches with the speed of its associated blanket cylinder 6*a,* and is then brought into rolling contact with the first upper blanket cylinder 6*a.* At the same time, the second plate cylinder 4*b* is disengaged from its associated second blanket cylinder 6*b* and is decelerated by its associated second drive motor 10*b* or by a not shown breaking system, so that when it has come to a stop, the printing plates of the second plate cylinder 4*b* may be changed. In this mode of operation, which is indicated in full lines in FIG. 4, the upper side of the running web 40 is printed by the first blanket cylinder 6*a.*

Moreover, the blanket-to-blanket printing unit 1 of the present invention may also be arranged In a horizontal orientation, in which the web 40 is running substantially vertically. Furthermore, a plurality of printing units 1 may be arranged on top of each other for printing a multi-colored image to the running web 40. FIG. 4 shows successive printing units, represented by the first printing unit 1 and an associated second printing unit 1' for successively printing on the running web 40 in an imprinting mode. In the second printing unit 1', elements similar to those of the first printing unit 1 are similarly labeled using apostrophes, (e.g., the first plate cylinder of the first printing unit 1 is labeled "4*a*" and in the second printing unit the first plate cylinder is labeled "4*a*"). As illustrated in FIG. 4, when the first plate cylinder 4*a* is disengaged from the first blanket cylinder 6*a* (as represented by the dashed lines in the printing unit 1), the plate cylinder 4*a'* of the second printing unit 1' is engaged with the first plate cylinder 6*a'* (as represented by the dashed lines in the second printing unit 1'). Alternately, when the first plate cylinder 4*a* is engaged with the first plate cylinder 6*a,* the first plate cylinder 4*a'* is disengaged from the blanket cylinder 6*a'* in the second printing unit (as represented by the solid lines in FIG. 4). A similar operation can be associated with the lower plate cylinders of the successive print units 1 and 1'.

The printing unit 1 according to the present invention is preferably used in combination with a first and/or second blanket cylinder 6*a,* 6*b* of a known design which are rotatably supported in one side wall of the housing 2 of the printing unit 1 and which carry a known sleeve shaped or endless tubular printing blanket 7*a,* 7*b* (FIG. 4) which is sidewardly movable onto and off the respective blanket cylinder 6*a,* 6*b* through an aperture formed in the opposite side wall of the housing 2. According to this embodiment of the invention, a reregistering of the printing unit 1 can easily be achieved by advancing or retarding the respective first or second plate cylinders 4*a,* 4*b* without changing the phase or speed of the mechanically coupled first and second blanket cylinders 6*a,* 6*b.*

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embodied therein.

What is claimed is:

1. Apparatus for a web-fed rotary printing press comprising:

a first plate cylinder, a first blanket cylinder associated with said first plate cylinder, a second plate cylinder, a second blanket cylinder associated with said second plate cylinder, said second blanket cylinder being in rolling contact with and being mechanically coupled to said first blanket cylinder, a first drive motor for individually driving said first plate cylinder, a second drive motor for individually driving said second plate cylinder, and a third drive motor for mechanically driving said first and second blanket cylinders independently of said first and second drive motors.

2. Apparatus according to claim 1, wherein said first and second blanket cylinders are mechanically coupled via meshing gear wheels.

3. Apparatus according to claim 2, wherein said gear wheels are mounted to respective drive shafts of said first and second blanket cylinders.

4. Apparatus according to claim 1, wherein said third drive motor drives said first and second blanket cylinders via a drive gear.

5. Apparatus according to claim 4, wherein said drive gear comprises a gear wheel.

6. Apparatus according to claim 4, wherein said drive gear comprises a drive belt.

7. Apparatus according to claim 1, wherein one of said first and second blanket cylinders comprises a drive shaft and said third drive motor directly drives said first and second blanket cylinders via said drive shaft.

8. Apparatus according to claim 1, wherein said first plate cylinder is directly driven by said first drive motor.

9. Apparatus according to claim 1, wherein said second plate cylinder is directly driven by said second drive motor.

10. Apparatus according to claim 1, wherein said first plate cylinder is driven by said first drive motor via a drive gear.

11. Apparatus according to claim 10, wherein said drive gear comprises gear wheel.

12. Apparatus according to claim 10, wherein said drive gear comprises a drive belt.

13. Apparatus according to claim 1, wherein said second plate cylinder is driven by said second drive motor via a drive gear.

14. Apparatus according to claim 13, wherein said drive gear comprises a gear wheel.

15. Apparatus according to claim 13, wherein said drive gear comprises a drive belt.

16. Apparatus according to claim 1, wherein said first plate cylinder is displaceable, such that it is engageable with and disengageable from said associated first blanket cylinder when the printing unit is in operation.

17. Apparatus according to claim 16, wherein said second plate cylinder is displaceable, such that it is engageable with and disengageable from said associated second blanket cylinder when the printing unit is in operation.

18. Apparatus according to claim 17, wherein said printing unit is an imprinter printing unit, in which said first and second plate cylinders are engaged and disengaged in alternation for alternatively printing on a first and second side of a running web.

19. Apparatus according to claim 1, wherein an inker roller is associated with each of the first and second plate cylinders, said inker rollers being driven by said first and second drive motors respectively.

20. Apparatus according to claim 19, wherein the inker rollers are mechanically coupled to the first and second drive motors via a drive gear.

21. Apparatus according to claim 1, wherein the first blanket cylinder comprises a first endless printing blanket mounted thereon.

22. Apparatus according to claim 21, wherein the second blanket cylinder comprises a second endless printing blanket mounted thereon.

23. Apparatus according to claim 19, wherein the inker rollers are mechanically driven by at least one motor other than said first, second and third drive motors.

24. Web-fed rotary printing press for printing on a running material web comprising:

a first blanket-to-blanket printing unit and a second blanket-to-blanket printing unit, each including:

a first plate cylinder, a first blanket cylinder associated with said first plate cylinder, a second plate cylinder, a second blanket cylinder associated with said second plate cylinder, said second blanket cylinder being in rolling contact with and being mechanically coupled to said first blanket cylinder, a first drive motor for individually driving said first plate cylinder, a second drive motor for individually driving said second plate cylinder and a third drive motor for driving said first and second blanket cylinders mechanically independently of said first and second plate cylinders, wherein said first plate cylinder of said first printing unit and said first plate cylinder of said second printing unit are alternately engaged and disengaged with their associated blanket cylinder.

* * * * *